United States Patent [19]

Hölter et al.

[11] Patent Number: 4,941,824

[45] Date of Patent: Jul. 17, 1990

[54] METHOD OF AND APPARATUS FOR COOLING AND CLEANING THE ROOF AND ENVIRONS OF A COKE OVEN

[75] Inventors: Heinz Hölter, Beisenstrasse 39-41, D-4390 Gladbeck; Heinrich Igelbüscher, Gladbeck; Heinrich Gresch, Dortmund-Wickede, all of Fed. Rep. of Germany

[73] Assignee: Heinz Hölter, Gladbeck, Fed. Rep. of Germany

[21] Appl. No.: 351,615

[22] Filed: May 12, 1989

[30] Foreign Application Priority Data

May 13, 1988 [DE] Fed. Rep. of Germany ..... 3816463
May 20, 1988 [DE] Fed. Rep. of Germany ..... 3817205
Nov. 25, 1988 [DE] Fed. Rep. of Germany ..... 3839834

[51] Int. Cl.[5] ..... F27D 1/12

[52] U.S. Cl. ..... 432/233; 432/238; 98/115.1; 110/256

[58] Field of Search ..... 110/230, 256; 432/233, 432/237, 238

[56] References Cited

U.S. PATENT DOCUMENTS

| | | | |
|---|---|---|---|
| 2,278,581 | 4/1972 | Dexter | 98/40.05 |
| 3,188,065 | 6/1965 | Hofmann et al. | 432/238 |
| 3,994,210 | 11/1976 | Davis | 98/115.1 |
| 4,216,708 | 8/1980 | Wyatt et al. | 98/115.1 |
| 4,398,999 | 8/1983 | Van Laar et al. | 432/238 |
| 4,576,613 | 3/1986 | Miline | 98/115.1 |
| 4,619,210 | 10/1986 | Kennedy | 110/256 |
| 4,635,569 | 1/1987 | Domnitch | 110/256 |

*Primary Examiner*—Henry C. Yuen
*Attorney, Agent, or Firm*—Herbert Dubno

[57] ABSTRACT

Coking emissions in the regions of the roof of the coke oven and adjoining lateral wall regions are removed by removing jets of fresh air from one longitudinal side to the other longitudinal side where the air, entraining the contaminant, is collected. The collected gases are supplied to the dry and wet cleaning.

19 Claims, 3 Drawing Sheets

METHOD OF AND APPARATUS FOR COOLING AND CLEANING THE ROOF AND ENVIRONS OF A COKE OVEN

FIELD OF THE INVENTION

The present invention relates to a method of operating a coke oven so as to cool and maintain in a relatively clean state the roof portions, spaces above the roof and neighboring parts of a coke oven, to a method of cooling the roof and vicinity of a coke oven and maintaining it free from contaminants, and to an apparatus for carrying out this method. More particularly, the invention relates to the cooling of the upper portion of a coke oven and to the method and apparatus used for this purpose.

The invention also relates to a process for cooling and maintaining free from contamination the coke oven roof and neighboring regions of a horizontal-chamber coking oven by evacuating and cleaning the gases which arise at the coke oven roof and may be contaminated, i.e. may entrain contaminants along with such gases. In its apparatus aspects, the invention relates to the coke oven and especially its upper portion and associated means for cooling the coke oven roof and maintaining it free from accumulations or contaminants and for likewise cooling and maintaining free from contaminants neighboring regions of a horizontal-chamber coking oven.

BACKGROUND OF THE INVENTION

A horizontal-chamber coking oven may comprise, as is well known, a multiplicity of parallel chambers which are spaced apart transversely from one another along the length of the coke oven battery, have pusher doors along one side of the coke oven, each registering with one of the chambers, and have outlet doors along the opposite side of the coke oven, each registering with one of the chambers.

The roof of the coke oven is provided with a plurality of filling openings for each coking chamber and a carriage can be successively disposed above these openings and can have hoppers communicating with the openings so that, when the openings are uncovered for a respective chamber, a charge of coal to be subjected to coking, may be filled into the respective chamber.

Coking procedes in accordance with the principles described at page 156 ff of the Making, Shaping and Treating of Steel, 10th Edition, U.S. Steel Co., Pittsburg, Pa. (1985).

As will be apparent from this work, when the charge in each chamber has been coked, the glowing mass can be pushed out by removing the doors along the opposite vertical walls of the coke oven or battery for the particular chamber, driving a pusher through the pusher opening and displacing the glowing coke into a car from the outlet opening.

The door can be replaced and the chamber recharged for a subsequent coking operation It is known that the roof of a coke oven directly or in the region thereof tends to emit gases and may be so constructed and arranged as to enable contaminants to accumulate thereover. For this reason, a variety of cover seals, suction devices for the doors, riser-pipe suction devices and super structures have been provided to reduce emissions from the coke oven or to at least limit such emissions into the ambient atmosphere.

For example, it has been proposed to completely enclose the coke oven or coke oven battery in a single wall enclosure or housing, but this has proved to be problematic because it has been found to be difficult to control the climate in the enclosure and to regulate or minimize toxic or noxious component concentrations therein.

A particular problem arises when there is an interruption in the operation of the coke oven because of a failure and, for some reason, sudden and massive emissions erupt from the coke oven into the enclosure. In addition, failures in the riser pipe system for evacuating gases produced in the coke oven can also create serious emission problems which cannot be solved by systems for the total enclosure of the coke oven battery known heretofore.

OBJECTS OF THE INVENTION

It is, therefore, the principal object of the present invention to minimize emissions from the roof of a coke oven and the vicinity thereof and to maintain an environmentally sound condition of the coke oven roof and its environs while enabling climate control in this region.

Another object of the invention is to provide an improved method of cooling the roof and roof regions of a horizontal-chamber coke oven and maintaining same free from contaminants, whereby earlier drawbacks are avoided.

Another object of the invention is to provide an improved apparatus for carrying out this method

SUMMARY OF THE INVENTION

These objects and others which will become apparent hereinafter are attained, in accordance with the present invention by a method of cooling the roof region of a coke oven, namely the roof and adjoining lateral wall portions of the coke oven battery which can be provided with the door openings, and maintaining the roof region free from contaminants, or a method of operating a coke oven battery to the same effect, wherein the method comprises the steps of:

(a) enclosing the roof region with a suction housing defining a space with the roof region;

(b) continuously evacuating the space so as to maintain the space at a subatmospheric pressure;

(c) maintaining the space in communication with at least some regions of covered filling openings and regions of coke-oven doors of the coke oven; and (d) admitting fresh air to the space in a volume substantially equal to gases evacuated from the space.

In its apparatus aspects, the invention broadly comprises:

a suction housing enclosing the roof region and defining a space with the roof region;

means for continuously evacuating the space so as to maintain the space at a subatmospheric pressure;

means for maintaining the space in communication with at least some regions of covered filling openings and regions of coke-oven doors of the coke oven: and means for admitting fresh air to the space in a volume substantially equal to gases evacuated from the space.

In other words, the objects of the invention are achieved by providing above the coke oven roof and the neighboring regions a hollow space defined below a suction ceiling which is continuously evacuated by connection of the space to a suction line and pump or blower. The volume of gas drawn off from this region is replaced by a corresponding amount of fresh air and in the suction ceiling or hood, closable openings can be provided to correspond to the covered openings or covers and the coke oven doors.

The method of the invention, quite surprisingly, makes it possible to avoid deposits of floating contaminants on the roof region so that the entire coke oven roof region remains clean and is cooled to the desired temperature.

Of course, the word "clean" as used herein refers also to the air space above the roof region which could be contaminated by floating particles even where the roof itself can be dust free.

Since the air layers above the coke oven roof can reach high temperatures and, in addition, can carry contaminants both in a gaseous form and in the form of particulates or dust, the air layers are continuously evacuated and simultaneously fresh cool air is supplied in a corresponding volume so that, because of continuous air draft from the system, a particularly pleasant and ergonomically advantageous climate can be maintained on the coke oven roof and the neighboring regions.

The difficult work required in these regions, for example, for charging the coke oven chambers of the battery, for removing and replacing the covers for the charging openings, cleaning operations and the like, can be carried out in a more pleasant atmosphere. In addition, reliability, workplace safety and environmental considerations, all benefit.

According to an advantageous feature of the invention, the gases drawn off from the suction duct are subjected to both dry and wet cleaning, e.g. cyclone or filter collection and electrostatic precipitation for the dry cleaning and wet scrubbing for the wet treatment, so that removal of both gaseous and dustlike contaminants can be insured.

The most effective way of controlling the climate above the coke oven roof has been found to involve directing the fresh air traversely over the coke oven roof forming one longitudinal side of the coke oven battery, evacuating the air at the opposite longitudinal side of the coke oven battery, and cleaning the evacuated gases. An air circulation can thus be established above the coke oven roof whereby a minimum withdrawal of the gas, providing a relatively light continuous draft, is used to extract contaminants, while a comparatively small amount of fresh air is admitted from the opposite side, the bulk of the air being circulated in the space. An especially effective circulation of the fresh air which, of course, should not be allowed to become too contaminated with toxic or noxious components, is assured by assisting the fresh air movement over the coke oven roof by an edge suction. This insures that the contaminants will be drawn off uniformly with the entraining air layers without creating possibly problematical turbulence on the coke oven roof.

With respect to the apparatus aspect of the invention, the suction ceiling can be formed by a roof structure of a hall shape which can extend over the entire coke oven battery and can be connected to the suction ducts. The hall-like ceiling, therefore, can be spaced above the coke oven roof and along one longitudinal side of the coke oven battery can be provided with fresh air pipe communicating with the respective nozzles which train jets of fresh air across the roof toward the opposite longitudinal side, i.e. transverse to the length of the coke oven battery.

On this opposite longitudinal side, the housing can be provided with a plurality of evacuation chimneys or stacks.

In this fashion, a relatively uniform air flow is generated over the shortest stretch of the coke oven battery so that contaminants are rapidly entrained with the air. The hollow space or the hollow spaces are so arranged that in no case can the contaminant-carrying air be released into the atmosphere, thereby preventing any environmental hazard.

To ensure a uniform withdrawal of the evacuated air and generate the requisite subatmospheric pressure without substantial cost, the housing at the longitudinal side thereof forming the chimney or chimneys has a stack-shape so that a thermal draft is created to assist the suction. In this case, the jets of air directed across the roof are supplemented with a subatmospheric pressure created by the draft and any suction source.

It has been found to be particularly advantageous to provide each two or three coke oven chambers or coking chambers of the coke oven battery with a respective chimney at the roof region, by contrast with a system which might have a single chimney for the entire coke oven or individual chimneys for each coke oven chamber. By comparison with the latter case, there is a substantially reduced investment or capital cost.

To insure entrainment of the contaminants in the fresh air at the earliest possible moment, it is desirable to minimize the spreading of the air jets and to provide air jets which extend without spreading to the greatest possible extent. The nozzle should direct the fresh air across the roof directly above the latter and the nozzles can be provided in a respective row for this purpose.

The gas immediately adjacent the coke oven roof is thereby carried away in the direction of the evacuating chimney without interference. Of course, this action can be controlled in dependence upon the type of contaminants that may be entrained by the air.

An edge suction has also been found to be advantageous and can be achieved by providing between the suction housing and the coke oven roof, an intermediate roof, partition or ceiling spaced closely above the filling openings and their covers and defining an intermediate space with the roof. This intermediate space can be closed toward the nozzles at one longitudinal side of the coke oven and can be open toward the opposite longitudinal side.

The nozzles are then trained to direct the respective air jets along the upper side of the partition or intermediate ceiling so that at the free edge thereof, an edge suction is created.

The air flow over the partition tends to hug the latter by the Coanda effect and, at the breakaway edge, creates the edge suction which carries the contaminants evacuated by this effect turbulently into the chimney. The Coanda effect contributes to a uniform flow of air across the roof structure of the coke oven.

The air movement above the coke oven roof region can be promoted by providing the housing and/or the chimney with a respective blower, fan or ventilator which can be controlled in response to the temperature of the roof region. The temperature of the roof region can also be used to control the flow from the respective nozzles.

The ventilators can operate automatically, therefore, when a higher temperature above the coke oven roof requires an improvement in the climate of the spaces or in augmented removal of contaminants which may collect there.

The entire operation can, therefore, be so automated that the intervention of personnel is no longer required.

It has been found to be advantageous, where high contaminant loadings can be expected from the coke oven roof region, especially where large areas must be covered without the provision of support structures, to space the suction housing at a distance of 50 to 150 mm from the coke oven roof and/or the lateral surfaces adjoining the roof and to subdivide the housing into coffers or bays. To improve the climate in the space it is also advantageous to provide nozzles which direct fresh air over this suction housing while insuring the collection of contaminated quantities of air from within the housing to allow the contaminants to be evacuated away without entering the atmosphere.

In the case when it is not possible to clean the evacuated air simultaneously or there is some failure in the gas cleaning system, it has been found to be advantageous to flare off the evacuated gases by providing the chimney or chimneys with igniters. A substantially uniform movement of the air above the coke oven roof can be insured when the nozzles form of the blowing nozzles correspond to the oven roof region and provide a epipolar or pencil shape jet of a length of 3.5 to 5d where d is the jet diameter. The fresh air entraining contaminants with it thus can provide the desired improvement in the climate above the coke oven roof and create the ergonomic conditions which allow working thereabove in a manner which cannot be attained with earlier coke oven operations.

The invention, therefore, provides a method and apparatus which precludes emission of contaminants into the atmosphere and provides good climatic conditions above the roof region so that the spaces there above can truly be considered as having been cleaned.

BRIEF DESCRIPTION OF THE DRAWING

The above and other objects, features and advantages of my invention will become more readily apparent from the following description, reference being made to the accompanying highly diagrammatic drawing in which.

SPECIFIC DESCRIPTION

Figure 1:
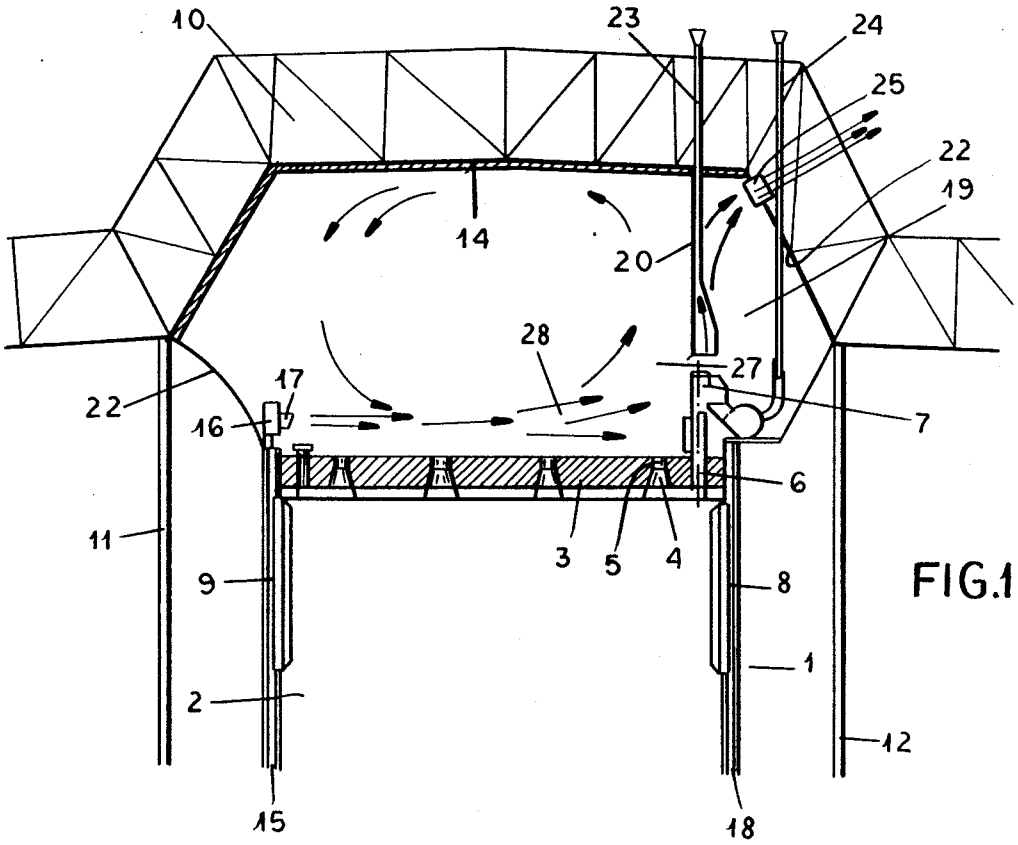
FIG. 1 is a diagrammatic vertical section through a portion of a coke oven battery in which the section planed is perpendicular to the longitudinal dimension showing a hall-spaced housing covering the roof and adjoining regions.

The coke oven battery 1 is provided, as described in the aforementioned publication, with a multiplicity of horizontal coking chambers 2 covered at the top by a horizontal coke oven roof 3. In the coke oven roof 3, filling openings 4 are provided and can be closed by covers 5. In addition, the roof 3 can be interrupted by gas-suction passages 6 which communicate with a receptacle 7 into which the gases produced in the coke oven can be drawn.

On the side walls, coke oven doors are provided through which the glowing and carbonized product can be driven out of the coke oven 2 using a pusher or the like.

The entire coke oven battery 1 is here covered by a roof construction 10 forming the housing of the present invention and which is carried by supports 11 and 12.

The roof construction 10 provides the possibility of mounting a suction ceiling or cover 14 at a distance from the coke oven roof 3 and which, as the arrows indicate, can provide complete isolation of the space above the roof region from the ambient atmosphere.

At a longitudinal side 15 of the suction ceiling, a fresh air pipe 16 is connected to the nozzles 17 extending along that side.

Fresh air is directed from these nozzles across the roof 3 to the region of the opposite longitudinal side 18, thereby entraining contaminants along with this air and into the exhaust chimney 19 from which the gas is fed to a cleaning apparatus providing dry and wet cleaning of the gas. The contaminants are not emitted into the atmosphere and hence the environment is not detrimentally effected.

Two partitions 20 and 21 define the flow path to the chimney 19 for the contaminant-laden gas. The partition 22 closes the space above the roof structure 10 or the suction ceiling, so that there will be a directed flow of air within this artificially created space.

To prevent environmental contamination at the receptacle, above this receptacle or its riser pipe, a riser-pipe chimney 23 is provided which draws off the gases and can include an igniter to flare them when this is necessary. The other partition 21 is combined with a flarer 24 by means of which the gas leaving the riser 23 can be flared if there is a problem in the operation of the coke oven battery. In the region of the chimney 19, ventilators 25, 32 are provided which can effect the air draft in this region. This air stream is represented at 27 and becomes the air stream which traverses the chimney 19 while the air stream 28 above the coke oven roof is generated substantially only by the air emerging from the nozzle 17. A circulation of this air stream 28 is possible when an overloading of the chimney 19 occurs, thereby resulting in a mixture of contaminant-laden air with fresh air which is always desirable.

Finally, by the special guidance of the air stream 28, 27, the invention provides the possibility that regions of the air stream which contain lesser amounts of contaminants can be recirculated to the region of the upper part of the housing and back to the nozzle 17 before they are entrained and eventually evacuated away. As a consequence, the overall atmospheric conditions below the housing and above the roof are advantageous.

Figure 2:
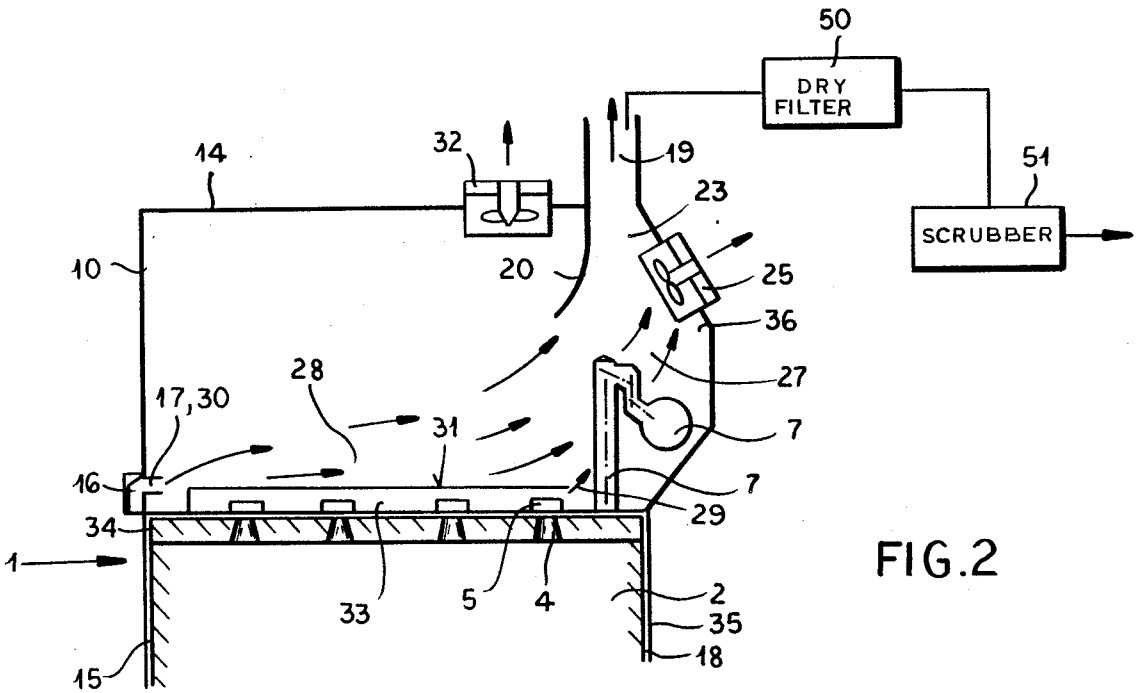
FIG. 2 is a similarly diagrammatic view of a coke oven battery and its evacuated housing has a shape designed to promote effective air flow.

FIG. 2 shows a suction ceiling 14 which may generally correspond in shape to that of FIG. 1 but has a special configuration in this figure to introduce uniformity of the air stream and provide a more reliable discharge of the contaminant-laden air.

Above the coke oven roof 3 and at a distance therefrom, an intermediate partition or ceiling 31 can be provided so that it is closed in the region 30 of the nozzles and opposite this region is open. The nozzles directed the jets of fresh air along the upper surface of this partition so that at the upper part of the intermediate space, an edge suction can be generated. The thus-generated edge suction and the Coanda effect of the air flowing along the partition promotes movements of the air over the entire height of the breadth of the oven in a completely effective manner across the furnace roof 3. In the intermediate space 33 between the intermediate cover 31 and the coke oven roof 3, a higher temperature is provided than in the remaining regions below the suction housing 14. The desired evacuation of gases can thus be achieved even in the region of the receptacle or collector 7 to retain this region free from contaminants.

The blower or ventilator 25 provided in the region and the chimney 19 and the ventilator 32 provided directly in the cover 14 can induce a directed flow of air into or out of the space to maintain the climate in the space between the housing and the roof region substantially constant.

Apart from the covering of the portion of the roof provided with filling openings and their covers, the housing 3 may also define spaces with the lateral surfaces 34 and 35 to collect gases arising in these regions and to carry off these collected gases together with the remaining gases.

The structure of FIG. 2 is highly advantageous because is provides in the region of the collector 17 a shaft-shaped bulge and path so that the air shaping under this region is uniformly and quasi forcibly directed into the chimney 19. From the latter, the gases can be fed, preferably to a gas cleaning installation. All of the fresh air can be passed directly through the working region above the coke oven roof 3 so that the workplace temperature can be reliably maintained and the desired reduction in the contaminant concentration can be reached. The shaped like structure region and the riser pipe support these air movements and their thermal draft effects.

As can be seen from FIG. 2, the gases leaving the stacks 19 can pass first through a dry dust-removal stage 50, e.g. a filter, and then through a wet cleaning stage 51, e.g. a scrubber before being discharged into the atmosphere.

Figure 3:
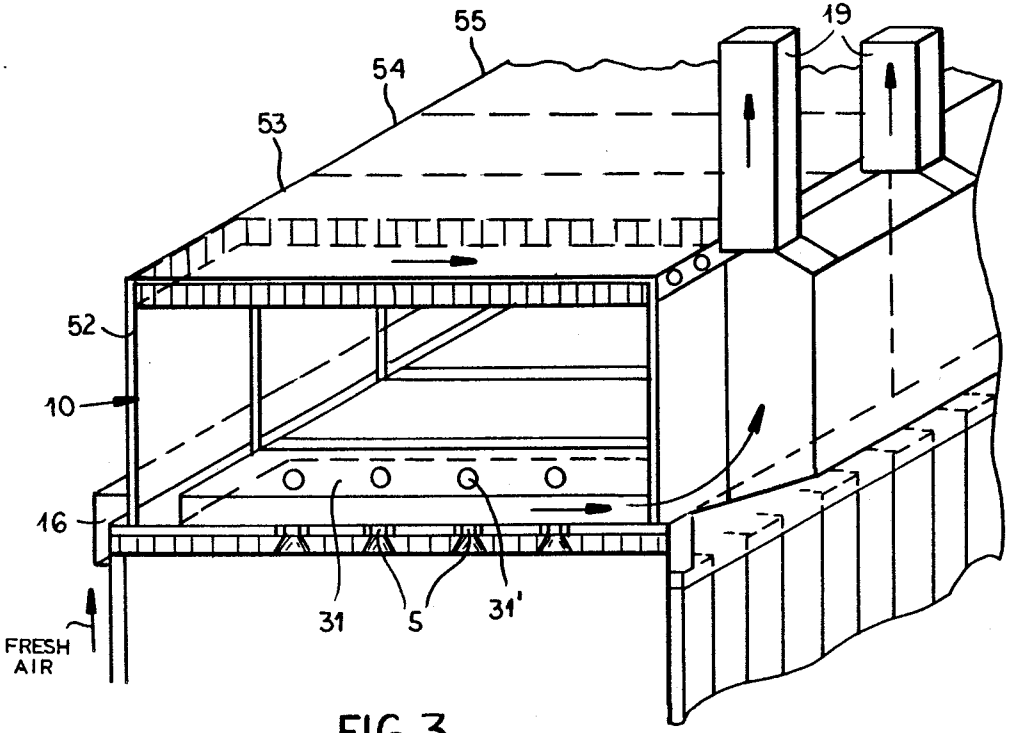
FIG. 3 is a perspective view, partly broken, showing an arrangement similar to that of FIG. 2.

FIG. 3 shows that the roof enclosure 10 can be assembled from individual roof sections 52–55 of which two or three can communicate with a single stack 19 of a plurality of such stacks. The intermediate members 31 can also be provided in separate sections for the respective roof section and can have closable openings 31 forming access openings providing access to the covers 5 and the filling ports 4.

I claim:

1. A method of cooling a roof region of a coke oven and maintaining said roof region free from contaminants, comprising the steps of:

(a) enclosing said roof region with a suction housing defining a space with said roof region;

(b) continuously evacuating said space so as to maintain said space at a subatmospheric pressure;

(c) maintaining said space in communication with at least some regions of covered filling openings and regions of coke-oven doors of said coke oven; and (d) admitting fresh air to said space in a volume substantially equal to gases evacuated from said space.

2. The method defined in claim 1, further comprising the step of subjecting the gases evacuated from said space to both dry and wet cleaning.

3. The method defined in claim 1 wherein said fresh air is blown across said roof region from one side thereof to an opposite side thereof, and is then evacuated and cleaned.

4. The method defined in claim 3, further comprising the step of assisting fresh air movement across said roof region by generating an edge suction at said region.

5. The method defined in claim 1, further comprising the step of assisting fresh air movement across said roof region by generating an edge suction at said region.

6. An apparatus for cooling a roof region of a coke oven and maintaining said roof region free from contaminants, comprising:

a suction housing enclosing said roof region and defining a space with said roof region;

means for continuously evacuating said space so as to maintain said space at a subatmospheric pressure;

means for maintaining said space in communication with at least some regions of covered filling openings and regions of coke-oven doors of said coke oven; and means for admitting fresh air to said space in a volume substantially equal to gases evacuated from said space.

7. The apparatus defined in claim 6, further comprising means for subjecting the gases evacuated from said space first to dry cleaning and then to wet cleaning.

8. The apparatus defined in claim 6 wherein said means for admitting fresh air includes nozzles for blowing fresh air across said roof region from one side thereof to an opposite side thereof, means for evacuating said air blown across said roof region at an opposite side, and means for cleaning the evacuated air.

9. The apparatus defined in claim 8, further comprising means for assisting fresh air movement across said roof region by generating an edge suction at said region.

10. An apparatus for cooling a roof region of an elongated coke oven and maintaining said roof region free from contaminants, comprising:

a hall-like suction housing enclosing said roof region and defining a space with said roof region;

means for continuously evacuating said space so as to maintain said space at a subatmospheric pressure;

means for cleaning gas evacuated from said space;

a plurality of nozzles arrayed along one longitudinal side of said coke oven for training jets of fresh air across said roof region in a vicinity of a roof of the coke oven;

means connected with said nozzles for feeding fresh air thereto; and means forming an exhaust chimney communicating with said space along an opposite longitudinal side of said coke oven and provided with said means for continuously evacuating said space for withdrawing some of the air blown across said roof by said nozzles.

11. The apparatus defined in claim 10 wherein said hall-like suction housing is formed with a shaft at said opposite longitudinal side constituting said chimney.

12. The apparatus defined in claim 10 wherein said coke oven has a plurality of coking chambers spaced apart in a longitudinal direction of the coke oven and said hall-like suction housing is formed with a respective chimney for each two to three coking chambers.

13. The apparatus defined in claim 10 wherein said means connected with said nozzles for feeding fresh air thereto includes pipes spaced along said one side and communicating with said nozzles, and said nozzles are disposed directly above said roof.

14. The apparatus defined in claim 10 wherein said roof is formed with filling openings for respective coking chambers of said coke oven spaced apart therealong, said filling openings being provided with respective covers, said space being provided with an intermediate ceiling spaced limitedly above said filling openings and said covers and defining with said roof an intermediate space closed toward said nozzles and open toward said chimney, said nozzles being oriented to blow fresh air over said intermediate ceiling.

15. The apparatus defined in claim 10 wherein at least one of said chimney and said housing is provided with a ventilator.

16. The apparatus defined in claim 15, further comprising means for controlling said ventilator and said nozzles in response to a temperature of said roof.

17. The apparatus defined in claim 10 wherein said housing is spaced substantially 50 to 150 mm above said roof and lateral surfaces of said roof region and is subdivided into respective coffer bays.

18. The apparatus defined in claim 10 wherein said chimney is provided with an igniter for flaring gases discharged therethrough.

19. The apparatus defined in claim 10 wherein said nozzles are shaped with respect to a width of the oven roof, to discharge epipolar pencil shaped jets of a length of substantially 3.5 to 5 d where d is the jet diameter.

* * * * *